United States Patent [19]

Khan

[11] 4,084,497

[45] Apr. 18, 1978

[54] REFUSE COMPACTOR

[75] Inventor: Aman Ullah Khan, Stevensville, Mich.

[73] Assignee: Whirlpool Corporation, Benton Harbor, Mich.

[21] Appl. No.: 774,329

[22] Filed: Mar. 4, 1977

[51] Int. Cl.[2] ..... B30B 1/18

[52] U.S. Cl. ..... 100/53; 53/124 B; 100/229 A

[58] Field of Search ..... 100/229 A, 290, 53, 100/255; 53/124 B; 141/73, 80

[56] References Cited

U.S. PATENT DOCUMENTS

| | | | |
|---|---|---|---|
| 3,768,399 | 10/1973 | Martiniak | 100/229 A |
| 3,807,295 | 4/1974 | Engebretsen | 100/53 |
| 3,838,636 | 10/1974 | Engebretsen | 100/229 A |
| 3,853,052 | 12/1974 | Engebretsen | 100/229 A |
| 3,882,771 | 5/1975 | Frohbieter | 100/53 |

*Primary Examiner*—Billy J. Wilhite

*Attorney, Agent, or Firm*—Wegner, Stellman, McCord, Wiles & Wood

[57] ABSTRACT

A refuse compactor structure wherein refuse collected in a flexible, outwardly opening container is compacted by downward movement of a ram thereagainst. The container is laterally supported during the compacting operation by an arrangement of walls substantially fully surrounding the container. The wall arrangement is constricted as a result of a preselected movement of the compacting ram to provide the desired lateral support during the compacting operation. The walls are retracted from the container as an incident of the ram being returned to a retracted position. The container is supported on a movable carrier which may be withdrawn through a front opening of an outer cabinet of the structure for introducing additional refuse into the container or for removing the container as for disposition of the compacted refuse. The carrier supports a door for selectively closing the front opening of the cabinet. The front wall for supporting the container during compaction may be fixedly mounted to the door and may be urged against the container by camming structure concurrently with the inward movement of the sidewalls of the container support. The rear wall for supporting the container during compaction may be fixedly mounted in the structure.

26 Claims, 8 Drawing Figures

5

11
33
33
36
34
53
53
31
61
60
66
48
43
48
25
49
49
62
69
60
61
39
39
46
60
48
41
43
61
13
48
26
5

33
33
40
36
37
11
35
34
53
53
38
51
31
50
39
39
32
66
41
48
47
49
69
42
23
21
22
29
27
30
20
19
26

REFUSE COMPACTOR

BACKGROUND OF THE INVENTION

1. Field of the Invention

This invention relates to refuse compactors and in particular to means for supporting the refuse container during the compacting operation.

2. Description of the Prior Art

In U.S. Pat. No. 3,853,052 of Einar O. Engebretsen, a refuse compactor is disclosed utilizing a flexible container for holding the refuse during the compacting operation. A movable plate is disposed outwardly of a side or bottom wall of the container and is manually retracted therefrom upon completion of the compacting operation to facilitate removal of the container. In one form, movement of the plate member is cam actuated. In another form movement is controlled by a linkage system.

In another form, the plate form is slidably positioned. In a further form, a rubber pad is positioned beneath the plate member for moving the container upwardly upon completion of the compacting operation.

Leonard J. Martiniak, in U.S. Pat. No. 3,768,399, shows another form of means for breaking adhesion between a refuse container and the compacted load of refuse therein. The container includes a movable wall portion adapted to move a limited distance laterally as it is moved upwardly by the removal of the compacted refuse therefrom. A lifting band encircles the refuse within the receptacle for use in withdrawing the compacted load and effecting the desired movement of the movable wall portion.

Einar O. Engebretsen further shows, in his U.S. Pat. No. 3,838,636, a movable backup plate which is shiftable outwardly from the wall of the liner by means of a manually pivotable bail. The linear comprises a sectional liner.

In U.S. Pat. No. 3,807,295, also of Einar O. Engebretsen, he discloses a refuse compactor having an interlock automatically actuated by initial downward movement of the compacting ram to lock the drawer receptacle in aligned position beneath the ram.

SUMMARY OF THE INVENTION

The present invention comprehends an improved refuse compactor structure wherein sidewall means are provided arranged to substantially fully surround the container and thereby substantially fully laterally support the container during the compacting operation.

The arrangement of the sidewall means is constricted as a result of a preselected movement of the ram to compact the refuse in the container.

Upon completion of the compacting operation, the arrangement is caused to be enlarged so as to effectively free the container from the lateral supporting sidewall means for facilitated movement of the container to and from a front access position. In the illustrated embodiment, the container is carried on a supporting carrier to which is attached a front door normally closing a front opening of an outer cabinet of the compactor structure. Thus, when the door is moved to an open position, the container is brought fowardly through the front opening of the cabinet.

The flexible container and the compacted refuse may be lifted from the carrier when it is desired to dispose of the compacted refuse. Upon completion of such disposal, the container may be returned to be again supported on the carrier and reinstalled in the cabinet with the container being automatically aligned with the ram means of the compactor when the door is returned to the closed position across the front opening of the cabinet.

The sidewall means may include a pair of opposed sidewalls hingedly mounted to move between an upper, laterally outwardly displaced position and an lower, laterally inwardly displaced position. The sidewalls are caused to be moved to the upper position as a result of the ram being returned to a retracted position upwardly of the container.

The sidewalls are brought to the lower, inner position wherein they engage the confronting sidewall portions of the container, as a result of the ram being moved downwardly from the retracted position to effect a compacting operation.

The sidewall means may further include a front wall carried on the movable front door to be juxtaposed to a corresponding front wall portion of the container.

Camming means may be provided on the sidewalls and front wall for cooperatively urging the front wall rearwardly. Resultingly, the container is urged against a fixed rear wall within the cabinet whereby the entire sidewall of the container is effectively laterally supported during the compacting operation.

Cooperating shoulder means may be provided on the ram and sidewalls for urging the sidewalls upwardly and outwardly as an incident of the ram moving to the retracted position. Resilient biasing means may be provided for urging the sidewalls downwardly and inwardly when the ram is moved from the retracted position during the compacting operation.

The sidewalls may be provided with suitable interlocking means for cooperating with locking means associated with the support for locking the carrier in alignment with the ram means during the compacting operation, the locking action being effected concurrently with the lateral inward movement of the sidewalls into supporting relationship with the container.

Thus, the refuse compactor structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
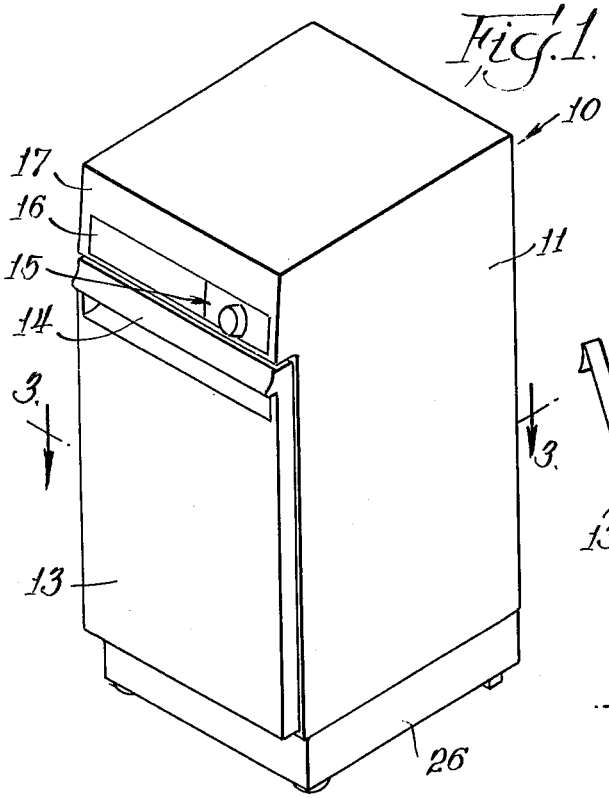
FIG. 1 is a perspective view of a refuse compactor embodying the invention.

In the exemplary embodiment of the invention as disclosed in the drawing, a refuse compactor generally designated 10 is shown to comprise an outer cabinet 11 having a front opening 12 selectively closed by a front door 13. The door may be manipulated by a suitable handle 14 and operation of the compactor may be effected by operation of a suitable electrical control knob 15 of a control panel 16 carried on a front wall portion 17 of the cabinet.

Door 13 may be supported on a carrier 18 provided with a suitable roller track means 19 associated with a complementary roller track means 20 carried by a base portion 26 of the comparator structure.

Figure 2:
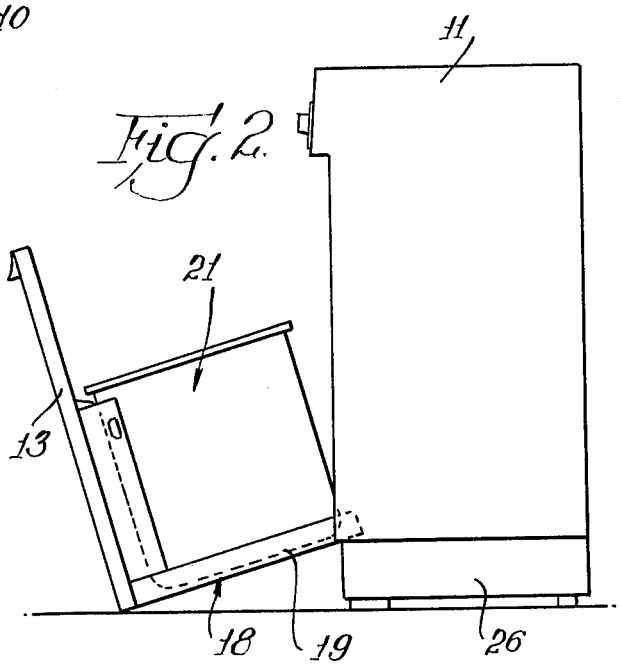
FIG. 2 is a side elevation thereof arranged for removal of the refuse holding container.
Figure 3:
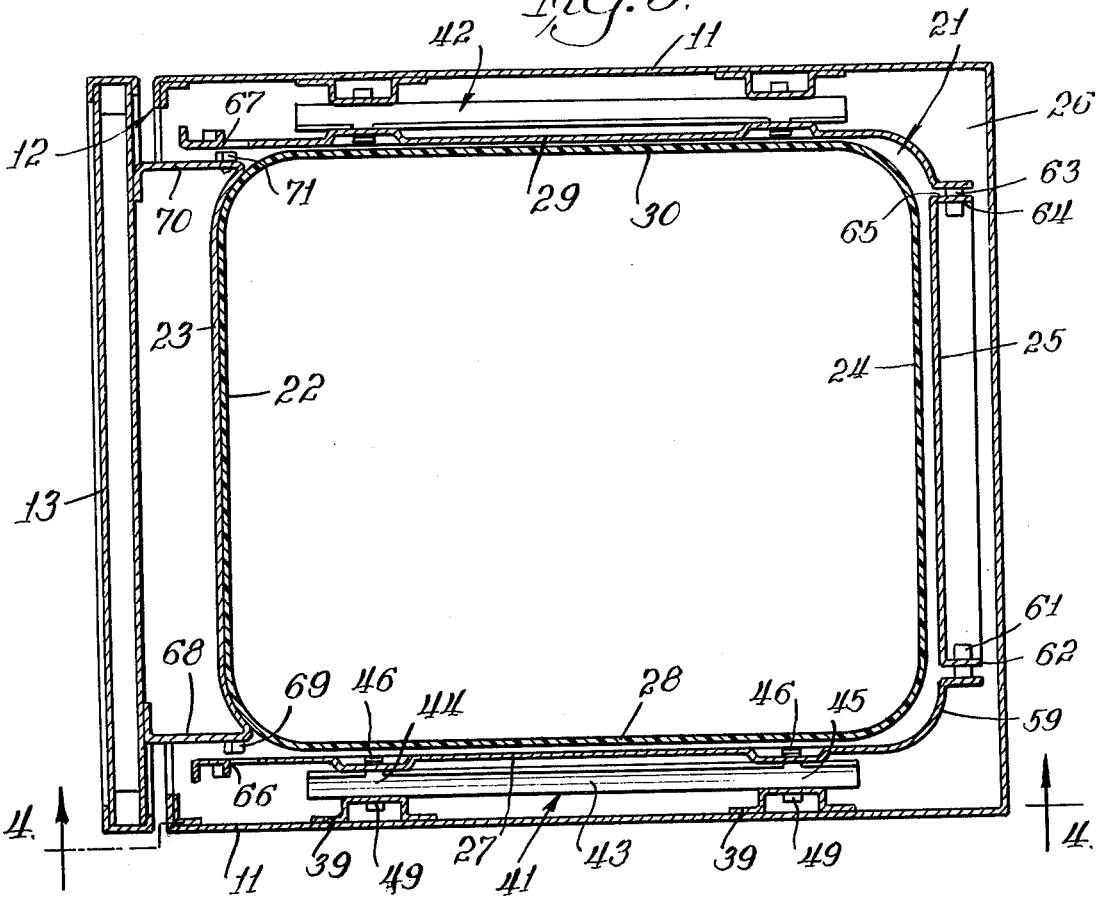
FIG. 3 is an enlarged horizontal section taken substantially along the line 3—3 of FIG. 1.

As shown in FIG. 2, in the forwardmost position, the carrier may be substantially fully removed from the cabinet to provide facilitated access to a container 21 removably supported on the carrier 18. As best seen in FIG. 3, the front upright wall 22 of container 21 is abutted to a front support wall 23 fixedly mounted to the door 13.

As further shown in FIG. 3, the rear wall 24 of the container is abutted to a rear support wall 25 fixedly carried on base 26 of the cabinet and mounting plate 38.

As further shown in FIG. 3, a right support sidewall 27 is facially juxtaposed to the right sidewall 28 of container 21 and a left support sidewall 29 is facially juxtaposed to a left sidewall 30 of the container when the container is disposed in the compacting position within cabinet 11. As shown in FIG. 3, a slight clearance is provided between walls 27 and 28 and between walls 29 and 30 to permit facilitated movement of the container inwardly and outwardly through the front opening 12 of the cabinet as desired.

Figure 4:
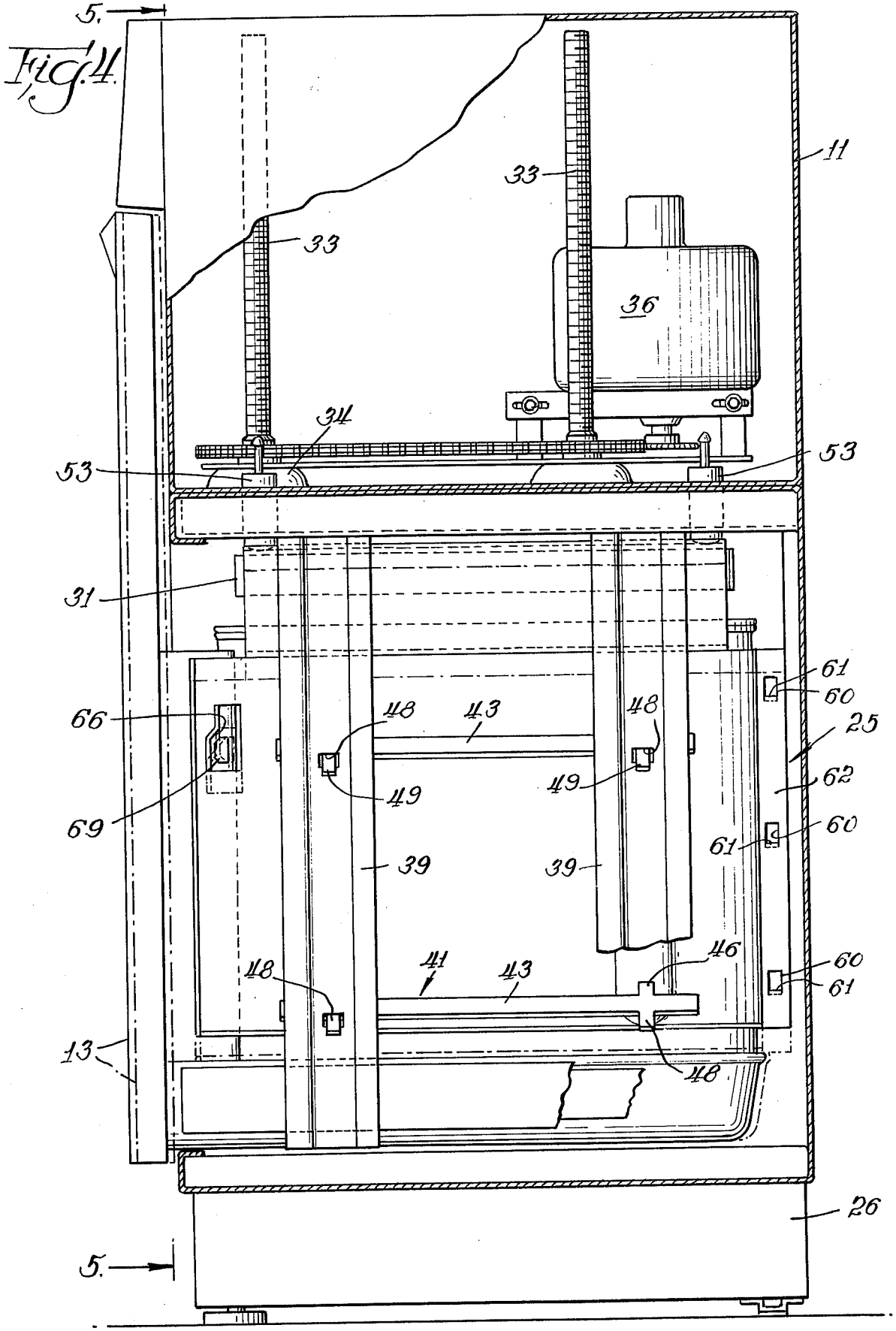
FIG. 4 is a vertical section taken substantially along the line 4—4 of FIG. 3.
Figure 5:
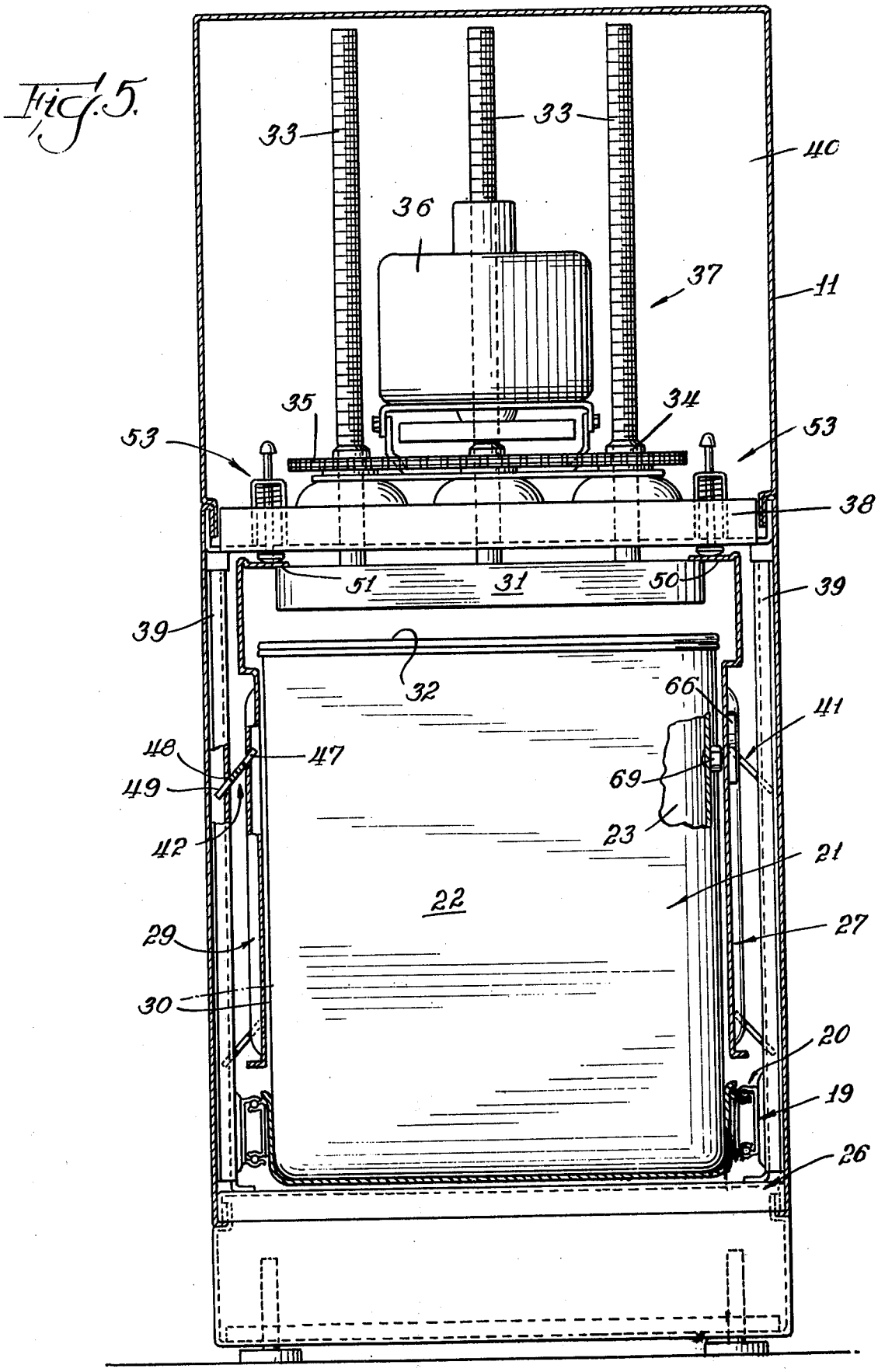
FIG. 5 is a horizontal section taken substantially along the line 5—5 of FIG. 4.

Compaction of refuse in container 21 is effected by a ram 31 which, as shown in FIGS. 4 and 5, is spaced above the top 32 of the container 21 in a retracted position of the ram. The ram is driven vertically by suitable drive screws or threaded support rods 33 threaded through cooperating threaded support members or power nuts 34 rotatably driven by a suitable drive 35 powered by a conventional electric drive motor 36. The ram driving structure generally designated 37 may be carried on a mounting plate 38 secured to a plurality of upright supports 39. Thus, as shown in FIG. 5, the ram is disposed subjacent the mounting plate 38 in the retracted position with the threaded rods 33 extending upwardly therefrom into a upper portion 40 of the outer cabinet 11. Upon suitable operation of the control knob 15 by the user, electric motor 36 is energized to rotate the threaded members 34 to forcibly urge the drive screws 33 downwardly to move the ram 31 downwardly through the open top 32 of the container 21 and against refuse deposited in the container to effect a desired compaction thereof within the container. Conventional means may be provided for causing a reversal of the ram movement upon completion of the compacting operation so as to return the ram to the retracted position automatically at the end of each compaction cycle. Thus, at any time, when the refuse compactor is not being operated in a compaction cycle, the carrier 18 with container 21 supported thereon may be moved outwardly from the cabinet, such as for adding additional refuse to the container or removing the container for disposal of the compacted refuse as desired.

In the illustrated embodiment, the container 21 is formed of a relatively flexible material, such as synthetic resin material, for example. The present invention is concerned with suitably supporting the sidewalls of the container during the compacting operation while yet providing the desired clearance between the sidewalls 28 and 30 and confronting supporting walls 27 and 29 upon completion of the compacting operation, as discussed above.

Thus, as best seen in FIGS. 3 and 5, support sidewall 27 is carried on a hinged device generally designated 41 and support sidewall 29 is carried on a corresponding hinged device generally designated 42. Each hinged device includes a support bar 43 having adjacent one end a pivot portion 44 and adjacent the opposite end a pivot portion 45. Each pivot portion includes an inner ear or shoulder 46 projecting through a suitable opening 47 in the support sidewall and an outer ear 48 projecting through an opening 49 in the upright support 39. Openings 47 and 49 define shoulders in the support sidewall for engaging shoulder 46. In the preferred embodiment two pivot portions per bar 43 are shown although more than two may be provided.

As shown in FIG. 5, right support sidewall 37 is provided at its upper end with an inturned flange 50 and left support sidewall 29 is provided at its upper end with a corresponding inturned flange 51. Flanges 50 and 51 are disposed to overlie ram 31 and to be urged upwardly thereby when the ram is returned to the retracted position of FIG. 5. Such upward movement of the flanges 50 and 51 carries each of the sidewalls 27 and 29 upwardly on the hinge means 41 and 42 and concurrently laterally outwardly away from the sidewalls 28 and 30 of the container 21.

Figure 8:
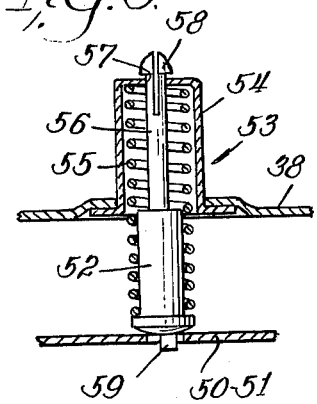
FIG. 8 is a vertical section of the means for biasing the sidewall means to the refuse supporting arrangement.

As shown in FIGS. 5 and 8, the flanges 50 and 51 bear against biasing devices 53 carried on the mounting plate 38. Each biasing device, as shown in FIG. 8, includes a plunger 52, a housing portion 54 carried by the support 38 and a compression coil spring 55 seated against the housing 54 and acting against plunger 52 to urge the plunger downwardly against the support wall flange. The plunger may be provided with a guide shaft 56 extending upwardly through an openingbiasing devices 53 carried on the mounting plate 38. Each biasing device, as shown in FIG. 8, includes a plunger 52, a housing portion 54 carried by the support 38 and a compression coil spring 55 seated against the housing 54 and acting against plunger 52 to urge the plunger downwardly against the support wall flange. The plunger may be provided with a guide shaft 56 extending upwardly through an opening 57 in the housing 54 and provided with an enlarged upper end 58 limiting the downward movement of the plunger. The terminal end of plunger 52 is located in holes 59 of flanges 50 and 51.

Figure 6:
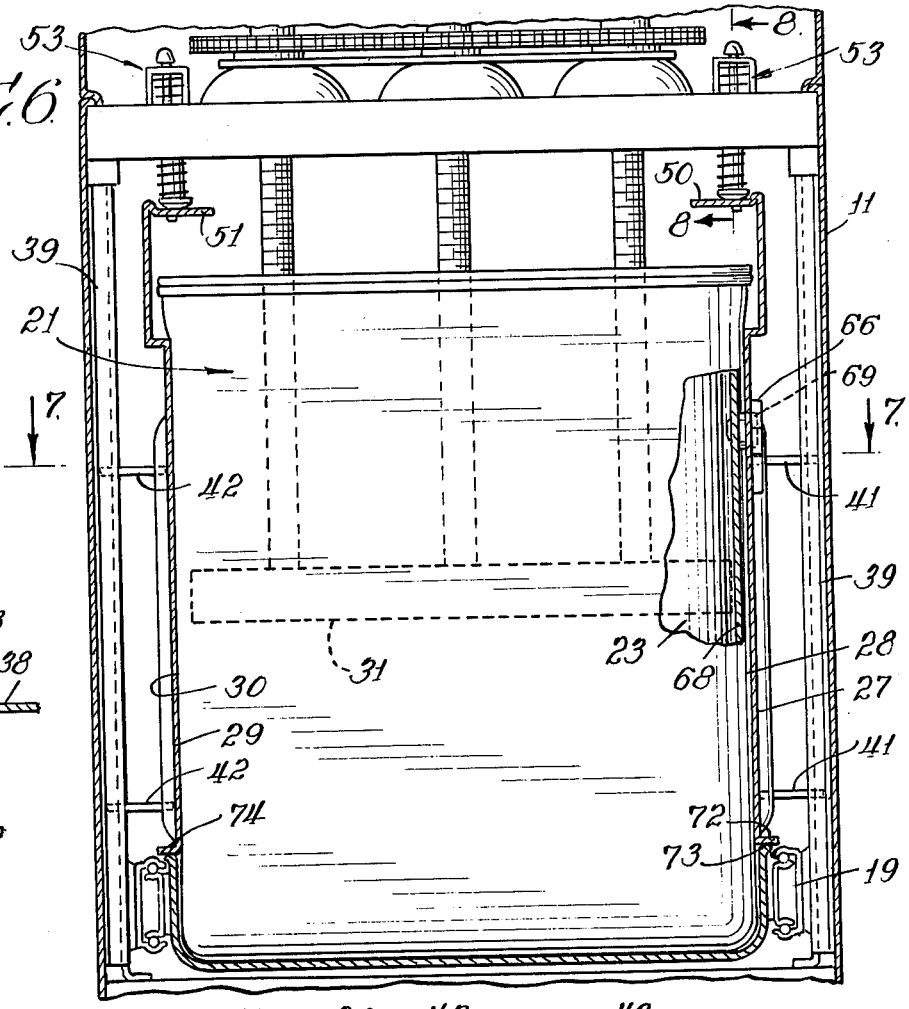
FIG. 6 is a fragmentary vertical section similar to that of FIG. 5 but with the sidewalls as disposed during a compacting operation.

Thus, as shown in FIG. 6, when the ram 31 is moved from the retracted position downwardly into the container 21 during a compacting operation, flanges 50 and 51 are free to move downwardly under the biasing action of devices 53 whereby support sidewall 27 is swung downwardly and inwardly on hinged device 41 and support sidewall 29 is swung downwardly and inwardly on hinged device 42. The downward movement of the sidewall 27 is limited by abutment of a lower flange 72 thereon with an upper edge portion or shoulder 73 of the carrier 18. Similarly, the downward movement of left sidewall 29 is limited by the abutment of a flange 74 thereon with the upper edge or shoulder 75 of the carrier. As shown in FIG. 6, in the lowermost position of the support sidewalls, the hinged devices 41 and 42 extend substantially horizontally, i.e. perpendicular to the upright supports 39 whereby the support sidewalls are effectively positively locked in fixed facial engagement with the sidewalls 28 and 30 of the container to provide a positive lateral support of the sidewalls during the compacting operation. The hinged devices are preferrable arranged to hinge slightly over center to ensure retention of pressure against the container walls.

As shown in FIGS. 3 and 4, right support sidewall 27 may be provided with a plurality of inturned tabs 60 received in corresponding vertical slots 61 in a rearwardly turned side flange 62 of the rear wall 25. Left support sidewall 29 may be similarly provided with a plurality of tabs 63 received in slots 64 of the left rearwardly turned flange 65 of the rear wall 25.

Figure 7:
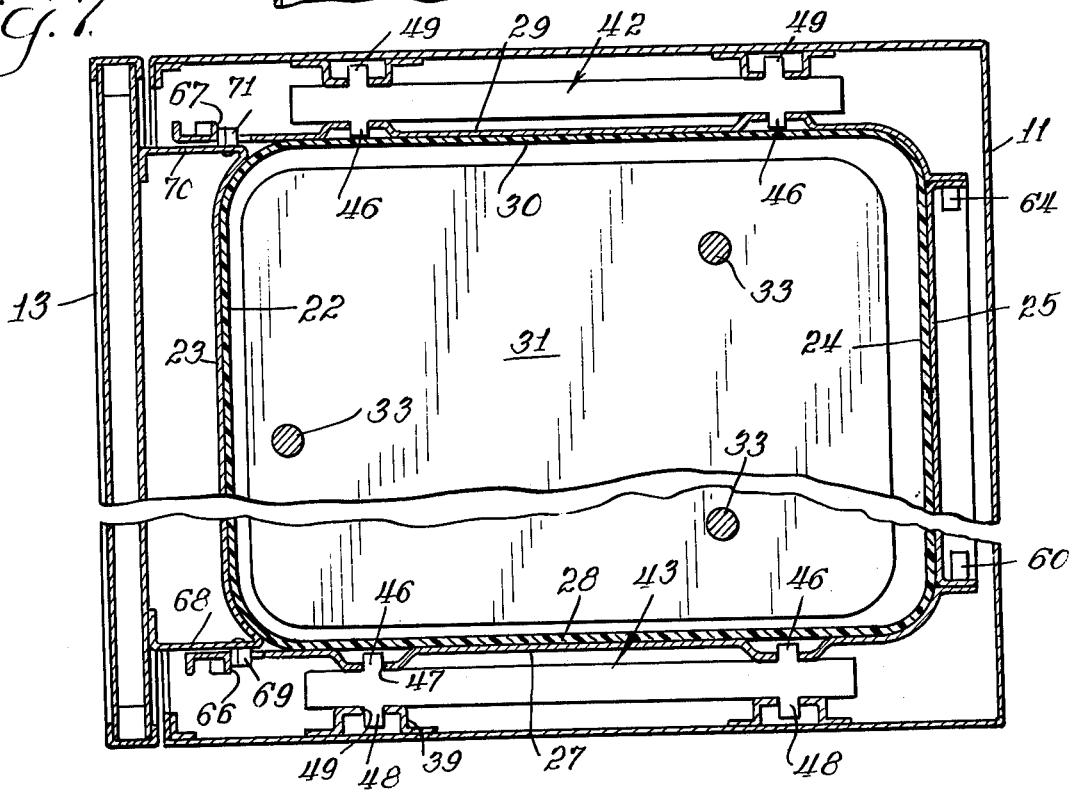
FIG. 7 is a frgamentary horizontal section taken substantially along the line 7—7 of FIG. 6.

As indicated briefly above, it is desirable to lock the carrier 18 in alignment with ram 31 during the compacting operation. Refuse compactor 10 provides an improved means for effecting such a locked condition utilizing the swinging movement of the support sidewalls to effect the desired locking. More specifically, as seen in FIGS. 3, 4 and 7, right support sidewall 27 defines a forward camming slot 66 and left support sidewall 29 defines a complementary camming slot 67. Front wall 23 is provided with a right mounting flange 68 having an outturned cam follower 69 thereon, and a left supporting flange 70 having an outturned cam follower 71 thereon.

As shown in FIG. 7, when the support sidewalls 27 and 29 are swung downwardly and inwardly, cam follower 69 is caused to enter the camming slot 66 and cam follower 71 is caused to enter camming slot 67.

Camming slots 66 and 67 are shaped so as to urge the cam followers 69 and 71 rearwardly as a result of the downward movement of the support sidewalls thereby urging the front support sidewall 23 and the door 13 inwardly. The inward movement of the front support wall 23 provides a lateral support for the front wall 22 of container 21 and maintains the rear wall 24 of the container in support relationship with the rear support wall 25, as shown in FIG. 7. The reception of the followers 69 and 71 in the camming slots 66 and 67 effectively locks the carrier 18 in alignment with the ram 31 and effectively prevents outward movement of the door and container during the compacting operation.

Thus, the support sidewall means is effectively arranged to substantially fully surround the container to provide an improved support of the flexible sidewalls of the container during the compacting operation. To effect such support, the sidewall arrangement is effectively constricted automatically as a result of the movement of the ram from the retracted position in effecting a compacting operation. The support sidewalls are effectively locked in supporting relationship to the container sidewalls during the compacting operation by a novel cooperative association of the support sidewalls with the supporting carrier and the cooperating arrangement of the hinged mounting means. The support sidewalls may be brought to the supporting arrangement by the spring biasing means, with the ram overcoming the spring biasing means in moving to the retracted position to effect a positive releasing movement of the support sidewalls to permit facilitated subsequent movement of the container to an accessible position forwardly of the cabinet front opening. The novel support sidewall structure further provides an effective positive locking of the carrier and container carried thereon in alignment with the ram during the compacting operation. Cammed association of the left and right sidewalls of the support sidewall means with the front sidewall further provides an automatic supporting association of the front support sidewall and rear support sidewall with the front and rear sidewalls of the container to provide the desired effectively full lateral support of the container during the compacting operation.

The foregoing disclosure of a specific embodiment is illustrative of the broad inventive concept comprehended by the invention. However, many changes and modifications of the invention may become apparent to those skilled in the art without departing from the spirit and scope of the invention.

I, therefore, intend to include within the Patent all such changes and modifications as may reasonably and properly be included within the scope of my contribution to the art.

Having described the invention, the embodiments of the invention in which an exclusive property or privilege is claimed are defined as follows:

1. In a refuse compactor structure including a ram and a carrier for removably carrying an upwardly opening container in which refuse may be collected to be compacted by movement of said ram forcibly downwardly into said container against collected refuse therein, the improvement comprising:

sidewall means arranged to surround said container; and means for causing the sidewall means to be constricted as a result of a preselected movement of said ram during a compacting cycle to provide a lateral support about said container during the compacting operation.

2. The refuse compactor structure of claim 1 wherein means are provided for forcibly enlarging said sidewall means arrangement for freeing said sidewall means from said container as a result of retraction of said ram from said container upon completion of a compacting operation.

3. The refuse compactor structure of claim 1 wherein said carrier includes means for limiting the constrictive movement of said sidewall means.

4. The refuse compactor structure of claim 1 wherein said means for causing said sidewall means arrangement to be constricted comprises resilient biasing means.

5. The refuse compactor structure of claim 1 wherein said sidewall means comprises a pair of sidewalls, a rear wall, and a front wall arranged in a generally parallelepiped arrangement.

6. The refuse compactor structure of claim 1 wherein said sidewall means comprises a pair of sidewalls, a rear wall, and a front wall arranged in a generally parallelepiped arrangement, one of said walls being fixed and the others of said walls being movable relative thereto during said constriction and enlargement of said arrangement.

7. The refuse compactor structure of claim 1 wherein means are provided for forcibly enlarging said sidewall means arrangement for freeing said sidewall means from said container as a result of retraction of said ram from said container upon completion of a compacting operation, said sidewall means defining a first shoulder, and said means for carrying said sidewall means arrangement to be enlarged comprising a second shoulder movable with said ram to engage said first shoulder as an incident of retraction of said ram from the container.

8. The refuse compactor structure of claim 1 wherein said sidewall means includes opposed sidewalls and a front wall, and cooperative camming means on said sidewalls and front walls for causing inward and outward movement of said front wall as an incident of corresponding inward and outward movement of said sidewalls.

9. The refuse compactor structure of claim 1 further including an outer cabinet having a front opening and a door selectively closing said front opening, said sidewall means including a front wall carried by said door.

10. The refuse compactor structure of claim 1 further including an outer cabinet having a front opening and a door selectively closing said front opening, said sidewall means including a front wall fixedly mounted to said door.

11. In a refuse compactor structure including a ram, and a carrier for removably carrying an upwardly opening flexible container in which refuse may be collected to be compacted by movement of said ram forcibly downwardly into said container against collected refuse therein, the improvement comprising:

a sidewall;

support means for movably mounting the sidewall in facial confronting relationship to the exterior of said container to support said container during compaction of the refuse therein; and means for causing the sidewall to be moved on said support means away from said container as a result of retraction of said ram from said container upon completion of a compacting operation.

12. The refuse compactor structure of claim 11 wherein said support means comprises means for swingably carrying said sidewall.

13. The refuse compactor structure of claim 11 wherein said support means comprises means for carrying said sidewall for concurrent vertical and horizontal movement.

14. The refuse compactor structure of claim 11 wherein positioning means are provided for positioning said sidewall in facially abutting relationship to said container as an incident of said ram moving into said container during the compacting operation.

15. The refuse compactor structure of claim 11 wherein positioning means are provided for positioning said sidewall in facially abutting relationship to said container as an incident of said ram moving into said container during the compacting operation, said positioning means including resilient biasing means.

16. The refuse compactor structure of claim 11 wherein positioning means are provided for positioning said sidewall in facially abutting relationship to said container as an incident of said ram moving into said container during the compacting operation, said positioning means including resilient biasing means and shoulder means disposed to limit the movement of said sidewall inwardly against said container.

17. The refuse compactor structure of claim 11 wherein positioning means are provided for positioning said sidewall in facially abutting relationship to said container as an incident of said ram moving into said container during the compacting operation, said positioning means including means for locking said sidewall means against outward displacement during the compacting operation.

18. The refuse compactor structure of claim 11 wherein cooperating locking means are provided on said movable sidewall and said carrier for locking said carrier in alignment with said ram during the compacting operation.

19. In a refuse compactor structure including a ram, and a carrier for removably carrying an upwardly opening flexible container in which refuse may be collected to be compacted by movement of said ram forcibly downwardly into said container against collected refuse therein, the improvement comprising:

an outer cabinet having a front opening;

a door carrier by said carrier for movement therewith and selectively closing said front opening when said carrier is fully received in said cabinet in alignment with said ram;

a sidewall;

support means in said cabinet for movably mounting the sidewall to abut a first portion of said container as a result of a preselected movement of said ram to compact refuse in said container;

a front wall carried by said door; and cooperating camming means on said sidewall and said front wall to urge said front wall against a second portion of said container as a result of said preselected movement of said ram.

20. The refuse compactor structure of claim 19 wherein said camming means further defines means for locking said door in closed relationship to said cabinet opening during compacting operating of said ram in said container.

21. The refuse compactor structure of claim 19 further including a rear wall fixedly supported in said cabinet opposite said front opening, a third portion of said container being urged against said rear wall as an incident of the compacting operation of said ram means in said container.

22. The refuse compactor structure of claim 19 wherein said support means comprise hinge means.

23. The refuse compactor structure of claim 19 wherein said front wall is fixedly mounted to said door.

24. The refuse compactor structure of claim 19 wherein said carrier limits the movement of said sidewall to effectively dispose said sidewall and front wall in preselected supporting abutment with said container portions.

25. The refuse compactor structure of claim 19 wherein said camming means includes a camming surface on said sidewall and a cam follower on said front wall moved into engagement with said camming surface as an incident of said preselected movement of said ram.

26. The refuse compactor structure of claim 19 wherein said camming means includes a camming surface on said sidewall and a cam follower on said front wall moved into engagement with said camming surface as an incident of said preselected movement of said ram to urge said front wall against said container second portion and concurrently lock said door against movement from said cabinet opening.

* * * * *